US006594967B1

(12) United States Patent
Panahii

(10) Patent No.: US 6,594,967 B1
(45) Date of Patent: Jul. 22, 2003

(54) SHEETROCK REPAIR SYSTEM

(76) Inventor: Abbas Panahii, 5462 Tyhurst Walkway #4, San Jose, CA (US) 95123

( * ) Notice: Subject to any disclaimer, the term of this patent is extended or adjusted under 35 U.S.C. 154(b) by 0 days.

(21) Appl. No.: 10/105,764

(22) Filed: Mar. 25, 2002

(51) Int. Cl.[7] ..... E02D 37/00
(52) U.S. Cl. ..... 52/514; 52/127; 156/71
(58) Field of Search ..... 52/514, 127; 156/71

(56) References Cited

U.S. PATENT DOCUMENTS 3,999,347 A 12/1976 Devlin
4,152,877 A 5/1979 Green
4,297,823 A 11/1981 Keisler
4,408,429 A * 10/1983 Neal ..... 52/514
4,644,723 A 2/1987 Weber
5,675,942 A * 10/1997 Crawford ..... 52/127.3
6,044,613 A * 4/2000 Crafts et al. ..... 52/741.1

* cited by examiner

*Primary Examiner*—Carl D. Friedman
*Assistant Examiner*—Steve Varner
(74) *Attorney, Agent, or Firm*—Sturm & Fix LLP

(57) ABSTRACT

A sheetrock repair system including a plate having two adhesive surfaces disposed laterally out from a central opening. A rubber tie extends through the central opening and a retaining wire extends through a transverse aperture in the tie.

6 Claims, 1 Drawing Sheet

SHEETROCK REPAIR SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of repair devices, and more particularly to a sheetrock repair system.

2. Description of Related Art

As can be seen by reference to the following U.S. Pat. Nos. 3,999,347; 4,152,877; 4,297,823 and 4,644,723, the prior art is replete with myriad and diverse wall repair devices.

While all of the aforementioned prior art constructions are more than adequate for the basic purpose and function for which they have been specifically designed, they are uniformly deficient with respect to their failure to provide a simple, efficient, and practical sheetrock repair system.

As a consequence of the foregoing situation, there has existed a longstanding need for a new and improved sheetrock repair system and the provision of such a construction is a stated objective of the present invention.

BRIEF SUMMARY OF THE INVENTION

Briefly stated, the present invention provides a sheetrock repair system including a plate having two adhesive surfaces disposed laterally out from a central opening. A rubber tie extends through the central opening and a retaining wire extends through a transverse aperture in the tie.

In use, a repair piece is cut to fill the damaged area of sheetrock. A number of plates are then adhered to the back surface of sheetrock repair piece so that the rubber tie extends out from the front surface adjacent the edge. A retaining wire is inserted through the transverse aperture in the tie to engage the front surface adjacent the edge. The repair piece is then positioned into the damaged area of the sheetrock with the ties extending out through the gap between the edge of the damaged area and the edge of the repair piece. The retaining wire is positioned to engage both the front surface of the damaged area and the front surface of the repair piece, and is biased toward the plate by the resilient rubber tie. The excess length of the rubber tie is then cut off and the area is filled with joint compound and finished.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
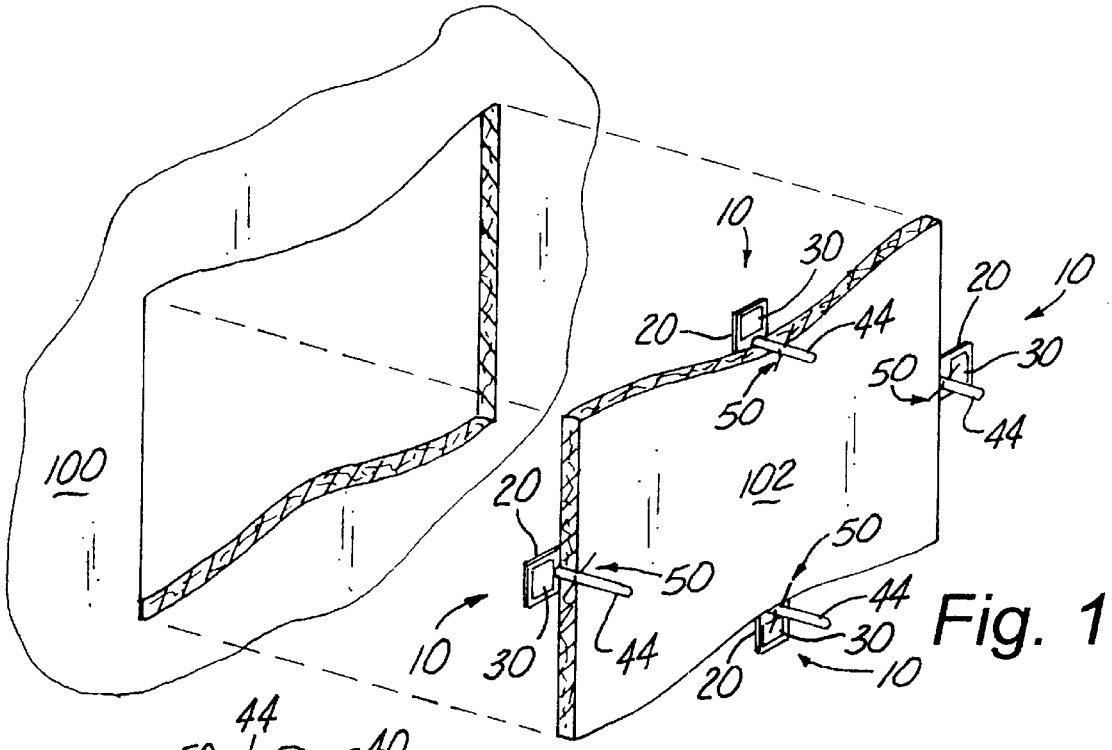
FIG. 1 is a perspective view illustrating the sheetrock repair system of the present invention with a number of connectors attached to a piece of sheetrock being used to repair a damaged area of sheetrock.
Figure 2:
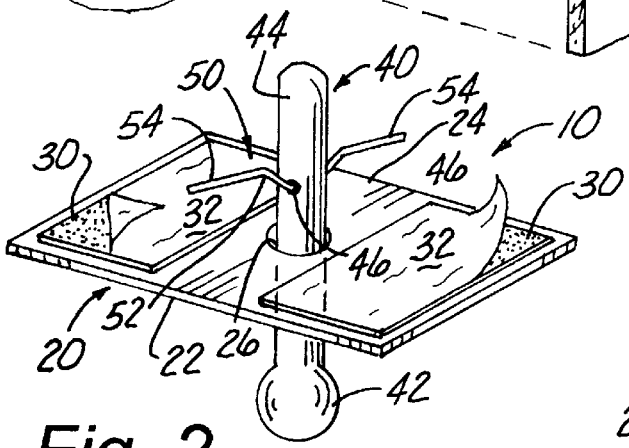
FIG. 2 is a perspective view of one of the sheetrock connectors showing the components and their relative orientations.
Figure 3:
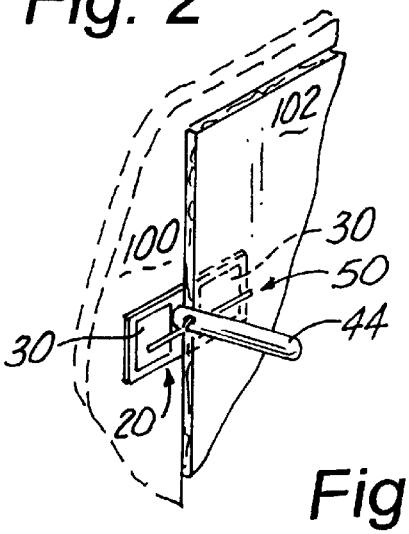
FIG. 3 is a perspective view illustrating the section of sheetrock positioned in the damaged area with the elastomeric tie extending through the gap between the edge of the damaged area and the edge of the repair piece.
Figure 4:
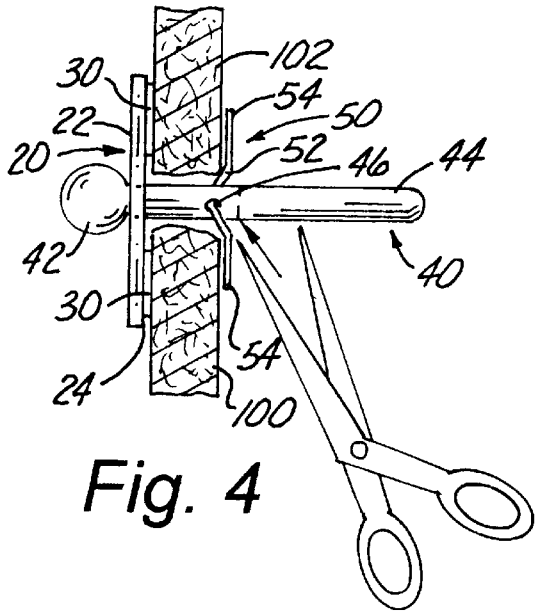
FIG. 4 is an enlarged sectional view showing the repair piece held securely in place between the plate and the retaining wire.

As can be seen by reference to the drawings, and in particularly to FIG. 1, the sheetrock repair system that forms the basis of the present invention is designated generally by the reference number 10. As most clearly shown in FIG. 2, the sheetrock repair system 10 includes a planar plate 20 having a rear face 22, a front face 24, and a central opening 26. Adhesive surfaces 30 are carried on the front face 24 of the plate 20 on lateral sides of the central opening 26. Removable protective sheets 32 are disposed over the adhesive surfaces 30. An elastomeric tie 40 has an enlarged head 42 and an elongated shaft 44 sized to be received through the central opening 26 in the plate 20. The shaft 44 includes a transverse aperture 46 formed therethrough and spaced from the elongated head 42 a distance less than the thickness of the sheetrock 100 being repaired. A retaining wire 50 including an offset central section 52 and outwardly extending ends 54 is sized to be received through the transverse aperture 46 in the tie.

In use, a repair piece 102 is cut to fill the damaged area of sheetrock 100. A number of plates 20 are then adhered to the back surface of sheetrock repair piece 102 so that the shaft 44 of the rubber tie 40 extends out from the front surface of the piece 102 adjacent the edge. A retaining wire 50 is inserted through the transverse aperture 46 in the shaft 44 to engage the front surface of the repair piece 102 adjacent the edge. The repair piece 102 is then positioned into the damaged area of the sheetrock 100 with the shafts 44 of the ties 40 extending out through the gap between the edge of the damaged area and the edge of the repair piece 102. The retaining wire 40 is positioned to engage both the front surface of the damaged area and the front surface of the repair piece and is biased toward the plate 20 by the resilient rubber tie 40. The excess length of the shaft 44 is then cut off and the area is filled with joint compound and finished.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A sheetrock connector, comprising:

a plate having a rear face, a front face, and a central opening formed through the plate;

an adhesive surface carried on the front face of the plate and disposed laterally out from the central opening;

an elastomeric tie including an elongated shaft sized to be received through the central opening of the plate, and an enlarged head sized larger than the central opening of the plate and being disposed to contact the rear face of the plate adjacent the central opening, the elongated shaft of the tie having a transverse aperture formed therethrough spaced from the enlarged head a distance less than the thickness of sheetrock being repaired; and a retaining wire sized to be received through the transverse aperture and having ends disposed to extend out laterally from the elongated shaft of the elastomeric tie.

2. The connector of claim 1 further including a removable protective sheet disposed over the adhesive surface on the front face of the plate.

3. The connector of claim 1 wherein the plate is formed of plastic.

4. The connector of claim 1 wherein the elastomeric tie is formed of rubber.

5. The connector of claim 1 wherein the retaining wire includes a central section offset from the laterally extending ends.

6. A method of repairing a damaged area of sheetrock using the connector of claim 1, the method comprising the steps of:

cutting a repair piece of sheetrock to a shape corresponding to the damaged area of sheetrock;

adhering a number of plates to a back surface of the repair piece such that the central opening of each plate is positioned out from and adjacent to an edge of the repair piece;

inserting an elastomeric tie through the central opening in each of the plates wherein the enlarged head of the tie engages the back surface of the plate;

inserting a retaining wire through the transverse aperture in each of the ties and positioning an end of each of the retaining wires to engage a front surface of the repair piece;

positioning the repair piece in the damaged area so that each of the plates adhere to a back surface of the damaged area and each of the ties extend out through a gap between the damaged area and the repair piece;

positioning each of the retaining wires to simultaneously engage the front surface of the damaged area and the front surface of the repair piece;

cutting and removing portions of each tie extending out from the front surfaces of the damaged area and repair piece; and filling and finishing the gap between the damaged area and the repair piece.

* * * * *